US010236620B2

(12) United States Patent
Kono et al.

(10) Patent No.: US 10,236,620 B2
(45) Date of Patent: Mar. 19, 2019

(54) CONNECTOR HAVING A CONNECTOR HOUSING WITH A HOLDING PORTION FOR HOLDING A SEALING RING

(71) Applicant: J.S.T. Mfg. Co., Ltd., Osaka-shi (JP)

(72) Inventors: Hironori Kono, Miyoshi (JP); Ryuji Kawaguchi, Miyoshi (JP); Seiji Yabuki, Miyoshi (JP); Hiroshi Fujiwara, Miyoshi (JP)

(73) Assignee: J.S.T. MFG. CO., LTD., Osaka-shi (JP)

( * ) Notice: Subject to any disclaimer, the term of this patent is extended or adjusted under 35 U.S.C. 154(b) by 0 days.

(21) Appl. No.: 15/667,016

(22) Filed: Aug. 2, 2017

(65) Prior Publication Data

US 2018/0062303 A1 Mar. 1, 2018

(30) Foreign Application Priority Data

Aug. 31, 2016 (JP) ..... 2016-169018

(51) Int. Cl.
*H01R 13/52* (2006.01)
*H01R 13/502* (2006.01)

(52) U.S. Cl.
CPC ..... *H01R 13/5202* (2013.01); *H01R 13/502* (2013.01)

(58) Field of Classification Search
CPC ..... H01R 13/5202; H01R 13/502; H01R 13/52019
USPC ..... 439/587, 271, 272, 274, 275, 279, 283
See application file for complete search history.

(56) References Cited

U.S. PATENT DOCUMENTS 6,953,357 B2 * 10/2005 Fukushima ..... H01R 13/5219 439/271
7,329,145 B2 * 2/2008 Yagome ..... H01R 13/506 439/271
7,572,150 B2 * 8/2009 Matsuoka ..... H01R 13/207 439/626
7,811,116 B2 * 10/2010 Sakakura ..... H01R 4/302 439/364

(Continued)

FOREIGN PATENT DOCUMENTS

JP 2016-048604 A1 4/2016

*Primary Examiner* — Harshad C Patel
(74) *Attorney, Agent, or Firm* — Kratz, Quintos & Hanson, LLP

(57) ABSTRACT

A seal ring mounting portion has: an outer circumferential surface portion that is provided so as to come into close contact with an inner circumferential portion of a seal ring, and extends along a circumferential direction of the seal ring in a state of being in close contact with the inner circumferential portion of the seal ring; and a holding portion that has a first wall portion provided on one width-direction side of the outer circumferential surface portion and a second wall portion provided on another width-direction side of the outer circumferential surface portion, the holding portion sandwiching and holding the seal ring from two sides in a width direction of the seal ring by the first wall portion and the second wall portion in the state of the seal ring being in close contact with the outer circumferential surface portion. The first wall portion and the second wall portion are provided so as to not overlap each other in a view from a central axis direction of the seal ring in a state of being mounted to the seal ring mounting portion.

5 Claims, 11 Drawing Sheets

(56) References Cited

U.S. PATENT DOCUMENTS

| | | | | |
|---|---|---|---|---|
| 8,241,062 | B2 * | 8/2012 | Tsuruta | H01R 9/032 439/352 |
| 8,419,485 | B2 * | 4/2013 | Stausser | H01R 13/4362 439/559 |
| 8,562,381 | B2 * | 10/2013 | Kawamura | H01R 11/12 439/801 |
| 8,747,154 | B2 * | 6/2014 | Uchiyama | H01R 13/5208 439/587 |
| 8,790,135 | B2 * | 7/2014 | Maegawa | H01R 43/24 439/246 |
| 2010/0261363 | A1 * | 10/2010 | Sakakura | H01R 4/34 439/271 |
| 2014/0179156 | A1 * | 6/2014 | Suzuki | H01R 13/5221 439/521 |
| 2014/0370737 | A1 * | 12/2014 | Okayasu | H01R 13/424 439/357 |

* cited by examiner

CONNECTOR HAVING A CONNECTOR HOUSING WITH A HOLDING PORTION FOR HOLDING A SEALING RING

CROSS-REFERENCE TO RELATED APPLICATION

This application claims priority to Japanese Patent Application No. 2016-169018. The entire disclosure of Japanese Patent Application No. 2016-169018 is hereby incorporated herein by reference.

BACKGROUND OF THE INVENTION

1. Field of the Invention

The present invention relates to a connector housing and a connector.

2. Description of Related Art

Conventionally, it is known that a seal ring is used in order to ensure waterproof capability between two housings. In a connector disclosed in JP 2016-48604A for example, as shown in FIG. 2 of this document, a seal ring (second seat ring 43) is fitted into a groove portion formed over the entire circumference of a housing-side mating portion 42 of one of the housings (front housing 40). A mating tube portion 31 of the other housing (rear housing 30) is fitted around the housing-side mating portion 42 of the one housing. Accordingly, as shown in FIG. 2 of JP 2016-48604A, a gap between the two housings 30 and 40 is seated by the second seal ring 43, thus achieving waterproofing between the two housings 30 and 40.

With the configuration described in JP 2016-48604A, the groove portion into which the seal ring 43 is fitted has the following configuration. Specifically, this groove portion has an outer circumferential surface portion that is in close contact with the inner circumferential surface of the seal ring 43 and extends along the circumferential direction of the seal ring, and two wall portions that protrude outward from the outer circumferential surface portion and sandwich and hold the two width-direction sides of the seal ring 43.

These two wall portions are continuous over the entire circumference in the circumferential direction, thus making it possible to hold the seal ring 43 so as to be securely sandwiched from the two width-direction sides.

SUMMARY OF THE INVENTION

Incidentally, in the case where the housing 40 having the above-described groove portion is to be manufactured using a mold, due to the structure of the housing, an upper mold and a lower mold need to be pulled away in the left-right direction (direction in which a terminal main body 21 extends) in FIG. 2 of JP 2016-48604A. However, the portion where the groove portion is formed in the housing 40 becomes an undercut, thus creating the need to provide a slide core for that portion, which raises the cost of the mold.

The present invention was achieved in order to solve the foregoing issues, and an object of the present invention is to provide a connector housing having a structure to which a seal ring can be fitted without inviting a rise in the cost of the mold.

(1) In order to solve the foregoing issues, a connector housing according to one aspect of this invention is a connector housing as a molded article having a seal ring mounting portion to which a seal ring is to be mounted, wherein the seal ring mounting portion includes: an outer circumferential surface portion that is provided so as to come into dose contact with an inner circumferential portion of the seal ring, and extends along a circumferential direction of the seal ring in a state of being in close contact with the inner circumferential portion of the seal ring; and a holding portion that has a first wall portion provided on one width-direction side of the outer circumferential surface portion and a second wall portion provided on another width-direction side of the outer circumferential surface portion, the holding portion sandwiching and holding the seal ring from two sides in a width direction of the seal ring by the first wall portion and the second wall portion in the state of the seal ring being in close contact with the outer circumferential surface portion, and the first wall portion and the second wall portion are provided so as to not overlap each other in a view from a central axis direction of the seal ring in a state of being mounted to the seal ring mounting portion.

According to this configuration, by mounting the seal ring to the seal ring mounting portion, the seal ring can be attached to the connector housing. Specifically, with this configuration, when the seal ring is mounted to the seal ring mounting portion such that the inner circumferential portion of the seal ring is in close contact with the outer circumferential surface portion, portions of the seal ring on the two width-direction sides are sandwiched and held by the first wall portion and the second wall portion. Accordingly, the seal ring can be securely attached to the connector housing.

Also, according to this configuration, the configuration of the mold used when molding the connector housing can be simplified for the following reasons.

For example, in the case where the portion of the connector housing into which the seal ring is fitted has wall portions that hold portions of the seal ring on the two width direction sides over the entire circumference as disclosed in JP 2016-48604A described above for example, it is necessary to use a mold that has a slide core, and the mold cost increases.

In contrast, with this configuration, the first wall portion and the second wall portion that sandwich and hold the seal ring are provided so as to not overlap each other in a view from the central axis direction of the seal ring in the state of being mounted to the seal ring mounting portion (i.e., in a view from the direction of removal from the mold). Accordingly, the seal ring mounting portion does not become an undercut portion, and there is no need for a slide core, thus making it possible to reduce the number of mold parts.

Accordingly, with this configuration, it is possible to provide a connector housing having a structure to which a seal ring can be fitted without inviting a rise in the cost of the mold.

(2) It is preferable that the holding portion includes a plurality of the first wall portions and a plurality of the second wall portions, the first wall portions and the second wall portions being arranged so as to alternate along an extending direction of the ocher circumferential surface portion.

If the seal ring mounting portion were configured using one first wall portion and one second wall portion for example, there would be concerns of problems such as the following. Specifically, when the seal ring is mounted to the seal ring mounting portion having one first wall portion and one second wall portion, the portion of the seal ring that is on the opposite side, in the width direction, to the portion that abuts against the first wall portion (i.e., the portion that does not abut against the second wall portion) extends continuously along the circumferential direction of the seal ring. Similarly, when the seal ring is mounted to the seal ring mounting portion having one first wall portion and one second wall portion, the portion of the seal ring that is on the opposite side, in the width direction, to the portion that abuts against the second wall portion (i.e., the portion that does not abut against the first wall portion) extends continuously along the circumferential direction of the seal ring. In this case, this portion easily becomes twisted relative to the seal ring mounting portion, or easily becomes separated from the seal ring mounting portion.

In contrast, with this configuration, a plurality of first wall portions and second wall portions are arranged so as to alternate along the circumferential direction of the outer circumferential surface portion. Accordingly, the portions of the seal ring that do not abut against the first wall portions or the second wall portions do not extend continuously along the extending direction of the outer circumferential surface portion. According to this configuration, portions of the seal ring that do not abut against the first wall portions, or portions of the seal ring that do not abut against the second wall portions, are not likely to become twisted or separated. In other words, according to this configuration, it is possible to prevent the seal ring mounted to the seal ring mounting portion from becoming twisted or separated from the seal ring mounting portion.

(3) It is preferable that the first wall portion and the second wall portion that are adjacent in an extending direction of the outer circumferential surface portion are respectively provided as an adjacent first wall portion and an adjacent second wall portion, and an end portion of the adjacent first wall portion on an adjacent second wall portion side and an end portion of the adjacent second wall portion on an adjacent first wall portion side are arranged on a straight line that extends in the central axis direction of the seal ring in the state of being mounted to the seal ring mounting portion.

According to this configuration, the lengths of the first wall portions and the second wall portions can be set long in the circumferential direction of the outer circumferential surface portion, without the first wall portions and the second wall portions overlapping each other in a view from the central axis direction of the seal ring when mounted to the seal ring mounting portion. Accordingly, it is possible to more reliably prevent twisting of the seal ring when attached to the seal ring mounting portion, and also separation of the seal ring from the seal ring mounting portion.

(4) It is further preferable that a parting line is formed on the outer circumferential surface portion, the parting line extending from the end portion of the adjacent first wall portion on the adjacent second wall portion side to the end portion of the adjacent second wall portion on the adjacent first wall portion side.

The meeting surfaces of the upper mold and the lower mold of the mold for forming the connector housing having the above-described configuration are portions where a parting line is formed on the connector housing. In other words, by configuring the connector housing so as to have the parting line described above, it is possible to manufacture the mold that does not need a slide core.

(5) In order to solve the foregoing issues, a connector according to another aspect of this inventions is a connector including: any of the connector housings described above; a seal ring mounted to the seal ring mounting portion of the connector housing; and a terminal portion housed inside the connector housing.

According to this configuration, it is possible to provide a connector that includes a connector housing having a structure to which a seal ring can be fitted without inviting a rise in the cost of the mold.

Note that the above and other objects, features, and advantages of this invention will become apparent by reading the Mowing description with the attached drawings.

DETAILED DESCRIPTION OF THE INVENTION

Hereinafter, modes for carrying out the present invention will be described with reference to the drawings. The present invention is broadly applicable to a connector housing and a connector that includes the connector housing.

Figure 1:
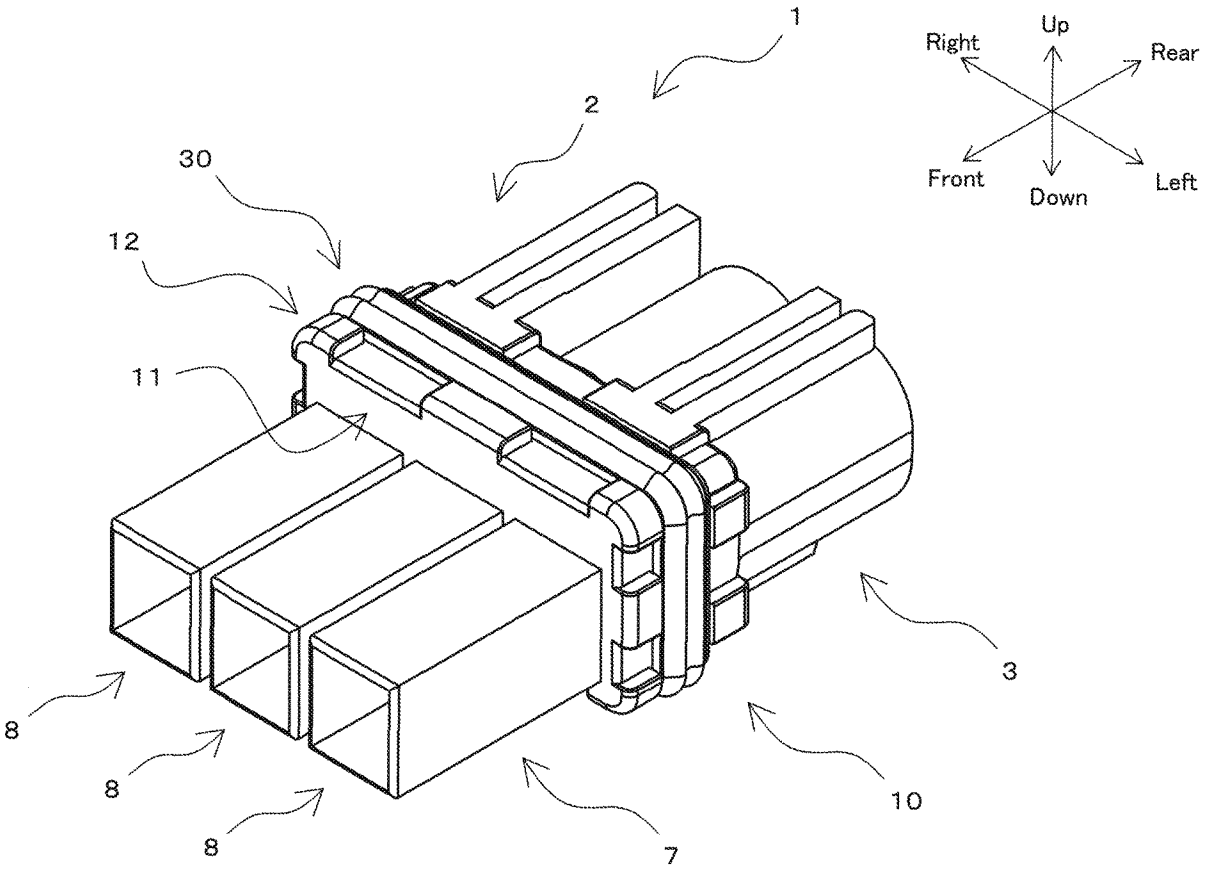
FIG. 1 is a perspective view of a connector according embodiment of the present invention.
Figure 2:
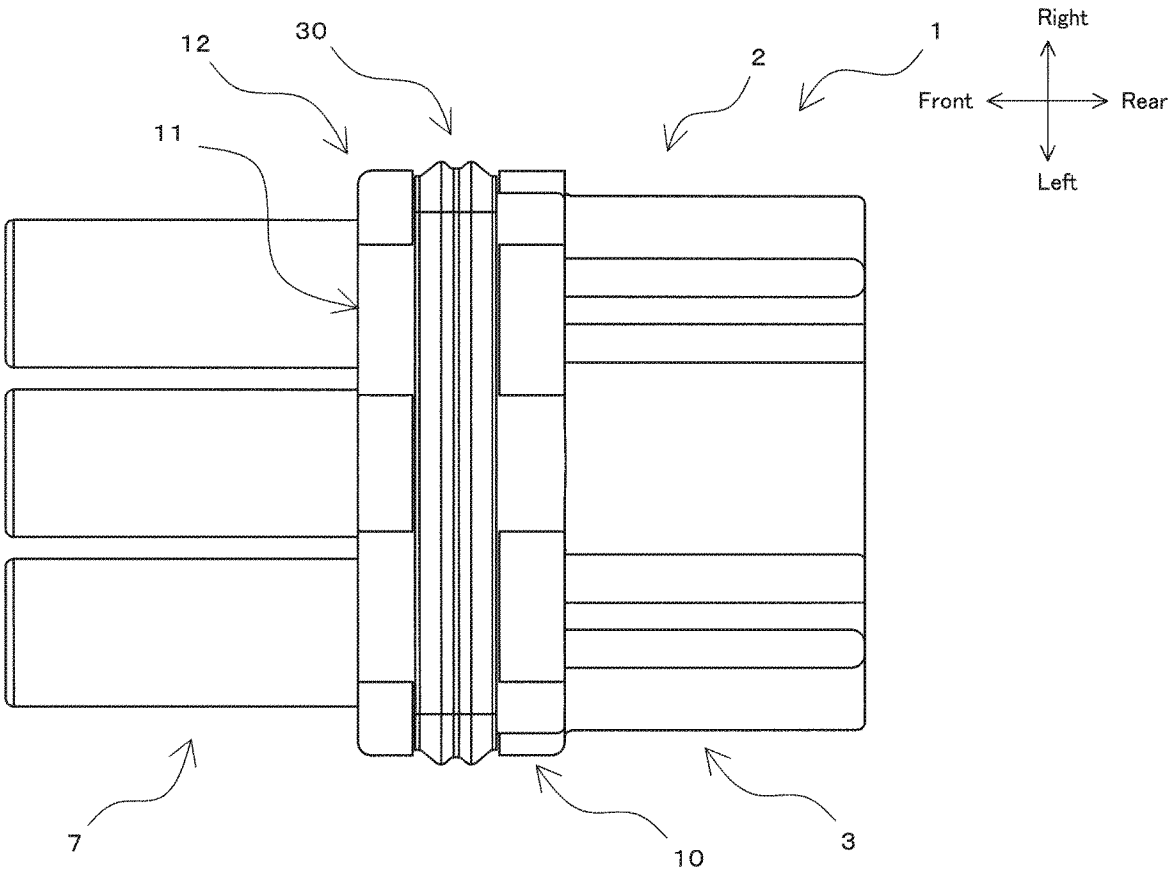
FIG. 2 is a diagram of he connector shown in FIG. 1, as viewed from above.

FIG. 1 is a perspective diagram showing the shape of a connector according to an embodiment of the present invention. FIG. 2 is a diagram of the connector shown in FIG. 1, as viewed from above.

Note that in the figures, for the sake of convenience in the description, the direction indicated by the arrow denoted by "right" will be referred to as rightward, the direction indicated by the arrow denoted by "left" will be referred to as leftward, the direction indicated by the arrow denoted by "up" will be referred to as upward, the direction indicated by the arrow denoted by "down" will be referred to as downward, the direction indicated by the arrow denoted by "front" will be referred to as frontward, and the direction indicated by the arrow denoted by "rear" will be referred to as rearward.

FIG. 1 and FIGS. 3, 5, 7, and 9 that will be described in detail later schematically show the shape of rectangular tube portions 8 of a terminal housing portion 7 of a connector housing 2, but omit illustration of exposed connector terminals that extend forward from inside the rectangular tube portions 8, or omit illustration of the internal structure of the connector housing 2 that can be seen through opening portions of the rectangular tube portions 8.

A connector 1 constitutes part of an electrical connection apparatus along with a partner connector (not shown) to which the connector 1 is to be mated. In the electrical connection apparatus, the connector 1 is electrically connected to the partner connector by mating them to each other.

Configuration of Connector

As shown in FIGS. 1 and 2, the connector 1 includes a connector housing 2, connector terminals (not shown), and a seal ring 30, and is formed by assembling these members together.

Configuration of Seal Ring

The seal ring 30 is constituted by an elastic member, and is formed with a rectangular shape that is longer in the left-right direction than in the up-down direction in a view along the front-rear direction. The seal ring 30 is mounted to a seal ring mounting portion 10 of the connector housing 2 that will be described in detail later.

In the electrical connection apparatus that has the connector 1 according to the present embodiment, in the state where the connector 1 is mated to the partner connector, the gap between the connector housing 2 and the housing of the partner connector is sealed by the seal ring 30. Accordingly it is possible to ensure waterproof capability between the connector 1 and the partner connector.

Configuration of Connector Housing

Figure 3:
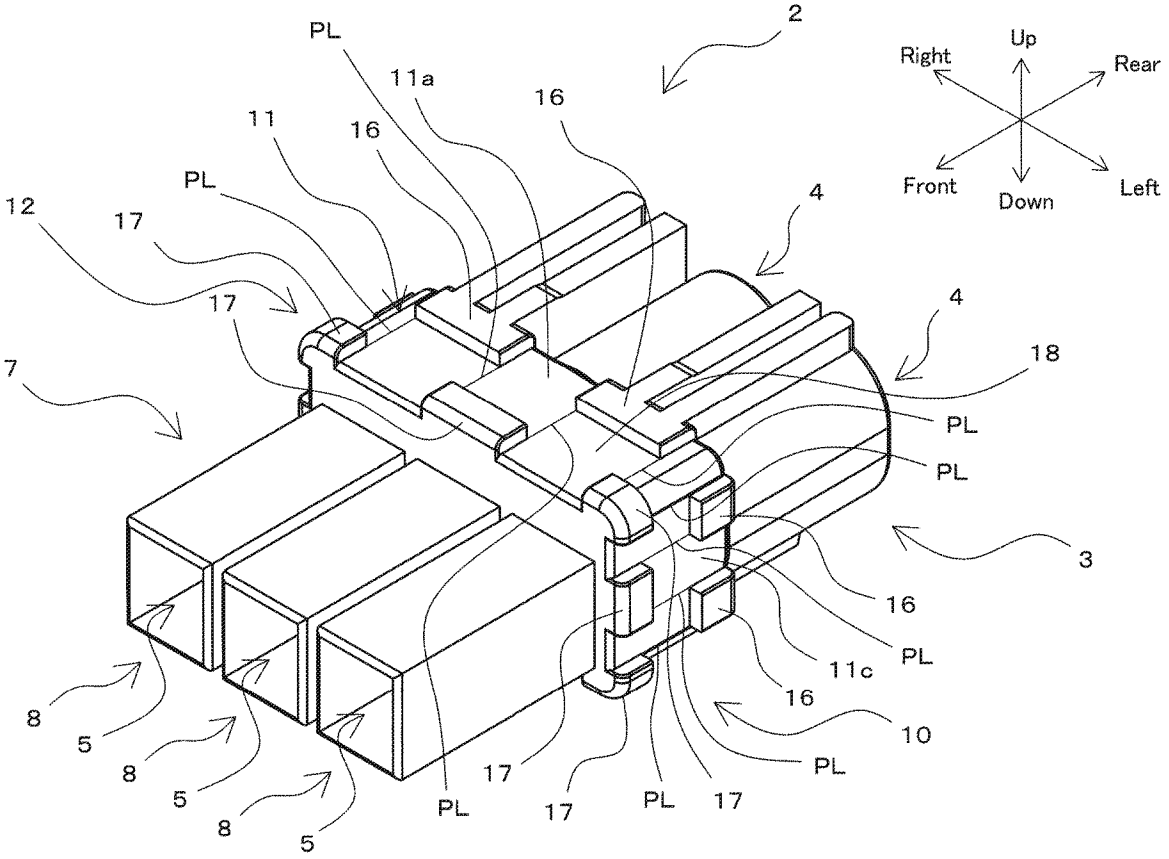
FIG. 3 is a perspective view of a connector housing shown in FIG. 1.
Figure 4:
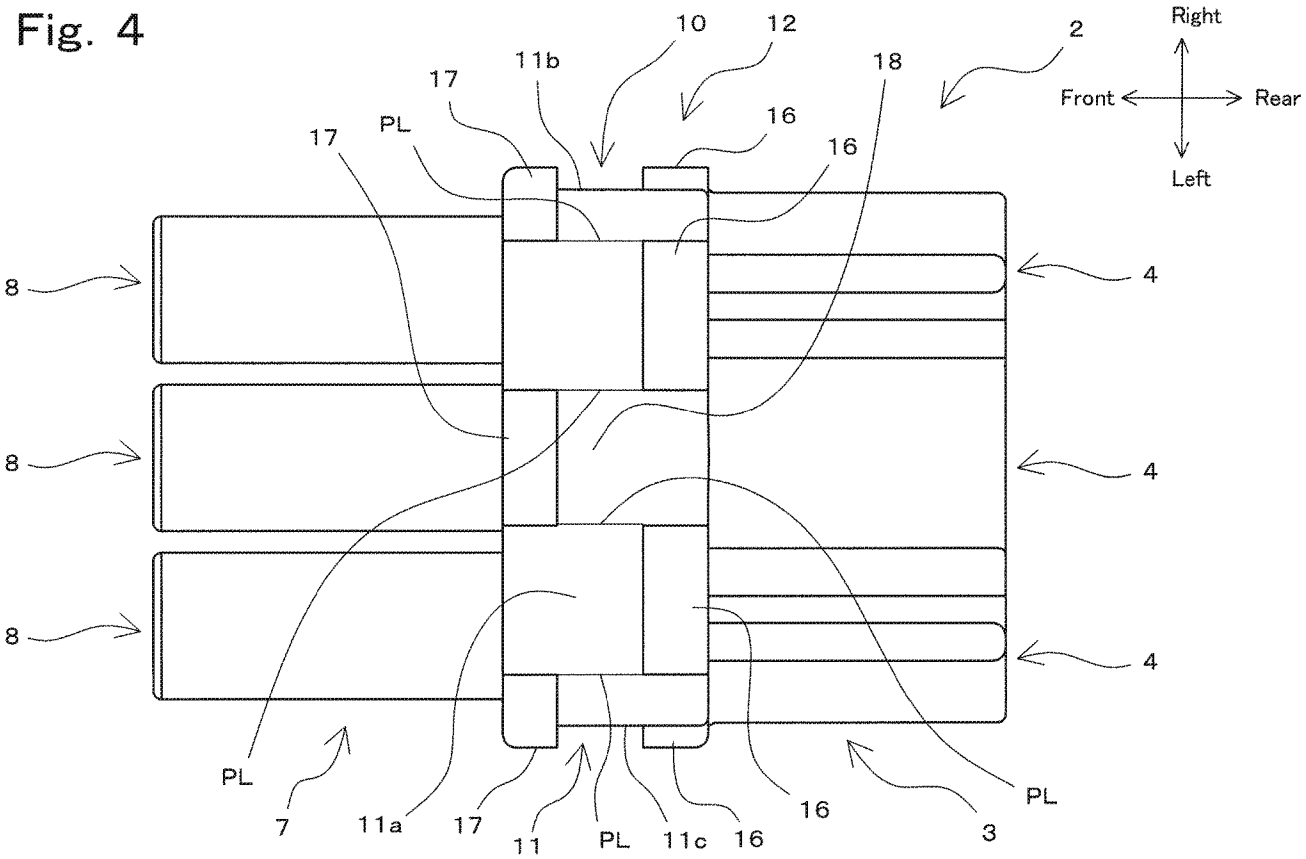
FIG. 4 is a diagram of the connector housing shown in FIG. 3, as viewed from above.
Figure 5:
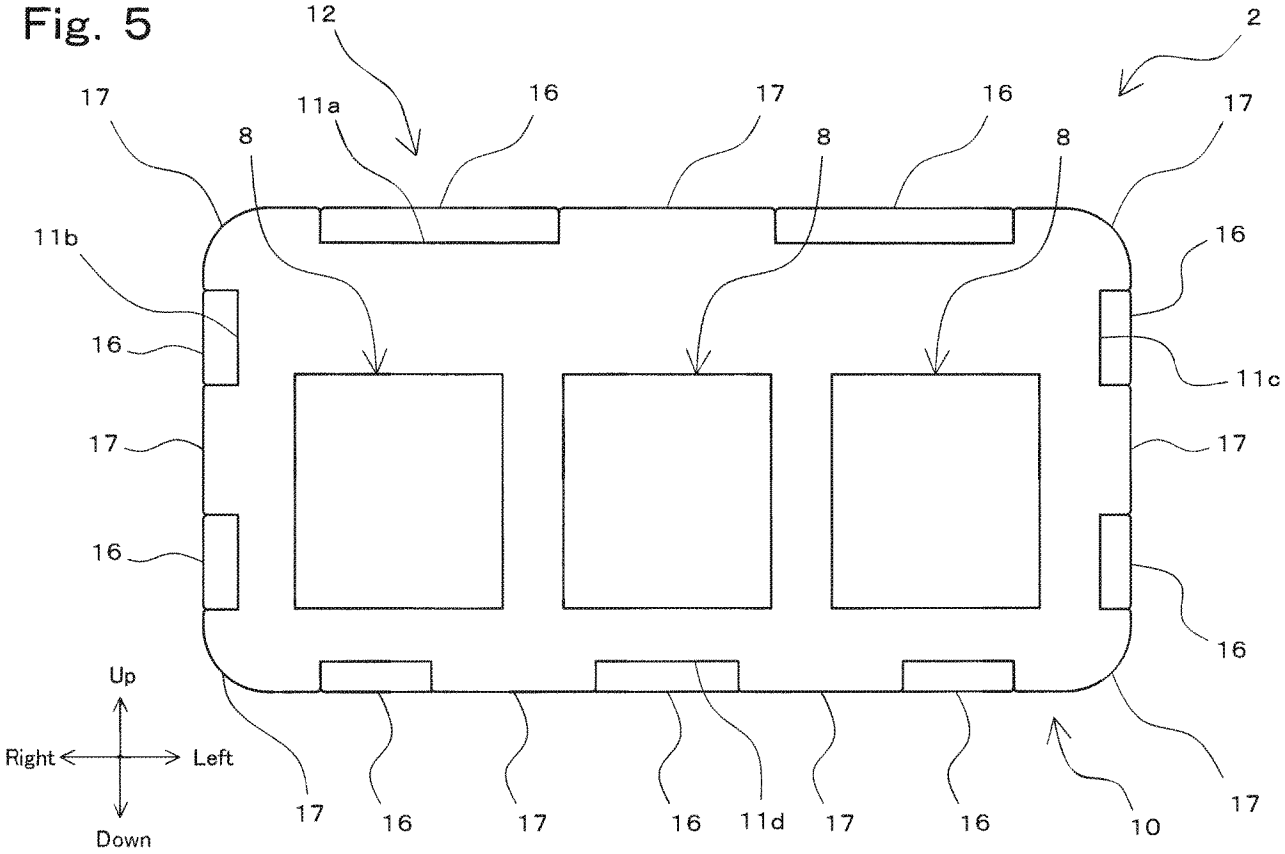
FIG. 5 is a diagram of the connector housing shown in FIG. 3, as viewed from the font.

FIG. 3 is a perspective view of the connector housing 2 shown in FIG. 1. FIG. 4 is a diagram of the connector housing 2 shown in FIG. 3, as viewed from above. FIG. 5 is a diagram of the connector housing 2 shown in FIG. 3, as viewed from the front.

The connector housing 2 is constituted by a resin member that has insulating properties. The connector housing 2 of the present embodiment is formed by heating a resin material so as to melt, injecting the melted resin material into a mold, and then allowing the resin material to cool so as to harden. In other words, the connector housing 2 is formed by injection molding.

The connector housing 2 has a shape of extending in the front-rear direction and being flattened in the up-down direction. Three through-holes 5 that extend inside the connector housing 2 in the front-rear direction are formed in the connector housing 2. These three through-holes 5 are formed with gaps between these three through-holes 5 in the left-right direction. Each of the through-holes 5 houses a connector terminal and a connector-terminal-side portion of a cable (not shown) to which the connector terminal is connected.

The connector housing 2 has a cable insertion portion 3, the terminal housing portion 7, and the seal ring mounting portion 10, and these portions 3,7,10 are formed integrally.

The cable insertion portion 3 has three tubular portions 4. The three tubular portions 4 are each formed with the shape of a tube that extends in the front-rear direction, and the cable whose leading end portion is connected to the connector terminal is inserted into each of the tubular portions 4. The three tubular portions 4 are aligned along the left-right direction, and are each formed integrally with adjacent tubular portions 4.

The terminal housing portion 7 has three rectangular tube portions 8. The three rectangular tube portions 8 are each formed with the shape of a rectangular tube that extends in the front-rear direction and each house the connector terminal in these three rectangular tube portions 8. These three rectangular tube portions 8 are aligned with gaps between these three rectangular tube portions 8 in the left-right direction.

The seal ring mounting portion 10 is a portion provided between the cable insertion portion 3 and the terminal housing portion 7, and is formed so as to bulge outward (in the up-down and left-right directions) from the cable insertion portion 3 and the terminal housing portion 7. The seal ring mounting portion 10 has a bulging portion 11 and a holding portion 12, and these portions 11,12 are formed integrally.

The bulging portion 11 is a flange-shaped portion provided so as to bulge outward (in the up-down and left-right directions) from a portion between the cable insertion portion 3 and the terminal housing portion 7. In a view along the front-rear direction, fire outer circumferential surface of the bulging portion 11 is shaped as a rectangle that is elongated in the left-right direction, and has a predetermined length in the front-rear direction. An upper surface 11*a*, a right side surface 11*b*, a left side surface 11*c*, and a lower surface 11*d* of the bulging portion 11 each have a flat shape. The portion between the upper surface 11*a* and the right side surface 11*b*, the portion between the upper surface 11*a* and the left side surface 11*c*, the portion between the right side surface 11*b* and the lower surface 11*d*, and the portion between the left side surface 11*c* and the lower surface 11*d* are each R-like.

The holding portion 12 has a plurality of first wall portions 16 and a plurality of second wall portions 17.

The first wall portions 16 are formed on rear-side portions of the outer circumferential surface of the bulging portion 11. The first wall portions 16 are each provided so as to protrude somewhat outward from the outer circumferential surface of the bulging portion 11.

Nine first wall portions 16 are formed in the connector housing 2 of the present embodiment. Specifically the upper surface 11*a*, the right side surface 11*b*, and the left side surface 11*c* of the bulging portion 11 are each provided with two first wall portions 16, and the lower surface 11*d* is provided with three first wall portions 16. The two first wall portions 16 formed on the upper surface 11*a* are each shaped as a rectangle that is elongated in the left-right direction, in a view from above. The two first wall portions 16 formed on the right side surface 11*b* are each shaped as a rectangle in a view from the right side. The two first wall portions 16 formed on the left side surface 11*c* are each shaped as a rectangle in a view from the left side. The three first wall portions 16 formed on the lower surface 11*d* are each shaped as a rectangle in a view from below. The front-side end surfaces of the first wall portions 16 are provided so as to be located at the same position in the front-rear direction.

The second wall portions 17 are formed on front-side portions of the outer circumferential surface of the bulging portion 11. The second wall portions 17 are each provided so as to protrude somewhat outward from the outer circumferential surface of the bulging portion 11, similarly to the first wall portions 16. The outward protruding amount of the second wall portions 17 is the same as the outward protruding amount of the first wall portions 16. In other words, the heights of the first wall portions 16 and the second wall portions 17 (heights based on the outer circumferential surface of the bulging portion 11) are the same as each other.

Nine second wall portions 17 are formed in the connector housing 2 of the present embodiment. Specifically, the upper surface 11*a*, the right side surface 11*b*, and the left side surface 11*c* of the bulging portion 11 are each provided with one second wall portion 17, and the lower surface 11*d* is provided with two second wall portions 17. Also, the R-like portion between the upper surface 11*a* and the right side surface 11*b*, the R-like portion between the upper surface 11*a* and the left side surface 11*c*, the R-like portion between the right side surface 11*b* and the lower surface 11*d*, and the R-like portion between the left side surface 11*c* and the lower surface 11*d* are each provided with one second wall portion. The second wall portion 17 formed on the upper surface 11*a* is shaped as a rectangle that is elongated in the left-right direction, in a view from above. The second wall portion 17 formed on the right side surface 11*b* is shaped as a rectangle in a view from the right side. The second wall portion 17 formed on the left side surface 11*c* is shaped as a rectangle in a view from the left side. The two second wall portions 17 formed on the lower surface 11*d* are each shaped as a rectangle in a view from below. The second wall portions 17 formed on the R-like portions between the surfaces 11*a*, 11*b*, 11*c*, and 11*d* of the bulging portion 11 are each formed with an R shape that conforms to the R-like portions on which the second wall portions 17 are formed. The rear-side end surfaces of the second wall portions 17 are provided so as to be located at the same position in the front-rear direction.

The seal ring 30 is mounted in the following manner to the seal ring mounting portion 10 having the configuration described above. Specifically, the seal ring 30 is mounted to the seal ring mounting portion 10 such that the inner circumferential portion of the seal ring 30 is in close contact with portions of the outer circumferential surface of the bulging portion 11 that are between the first wall portions 16 and the second wall portions 17 (i.e., in close contact with outer circumferential surface portion 18). This outer circumferential surface portion 18 is portions of the seal ring mounting portion 10 that come into close contact with the inner circumferential portion of the seal ring 30, and is provided so as to extend along the circumferential direction of the seal ring 30 when in close contact with the inner circumferential portion of the seal ring 30. In this state, portions of the seal ring 30 on the two sides in the width direction are sandwiched and held by the first wall portions 16 and the second wall portions 17. More specifically, the seal ring 30 is held in a manner of being sandwiched by the front-side end surfaces of the first wall portions 16 and the rear-side end surfaces of the second wall portions 17.

Relative positional relationship between first wall portions and second wall portions The first wall portions 16 and the second wail portions 17 are arranged in the following relative positional relationship with respect to each other when viewed along the front-rear direction. Specifically as shown in FIGS. 3 to 5, first wall portions 16 and the second wall portions 17 are provided so as to alternate along the circumferential direction (extending direction) of the outer circumferential surface portion 18, and furthermore not overlap each other in a view along the front-rear direction. The first wall portions 16 and the second wall portions 17 are arranged in this manner in order to simplify the configuration of the mold used to mold the connector housing 2.

Figure 10:
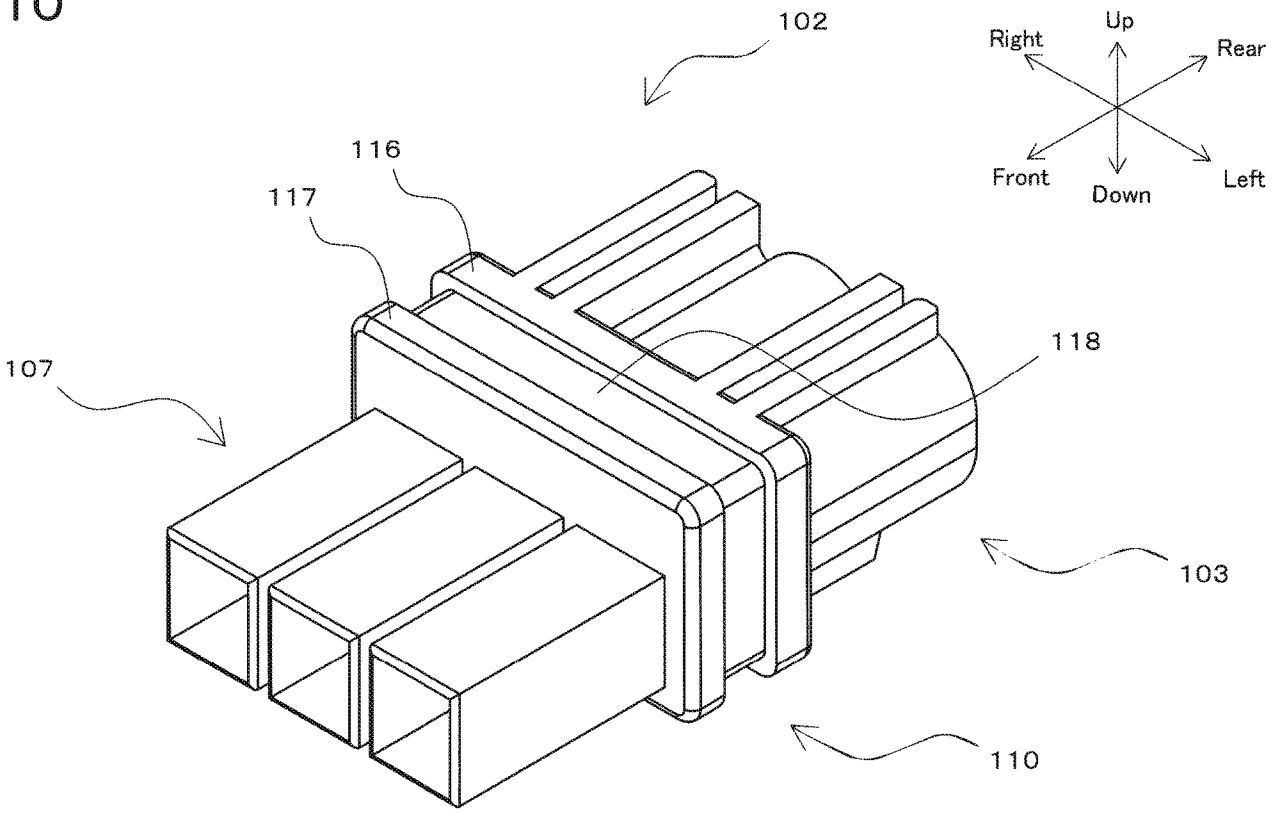
FIG. 10 is a perspective view of a connector housing that is conventionally known.
Figure 11A:
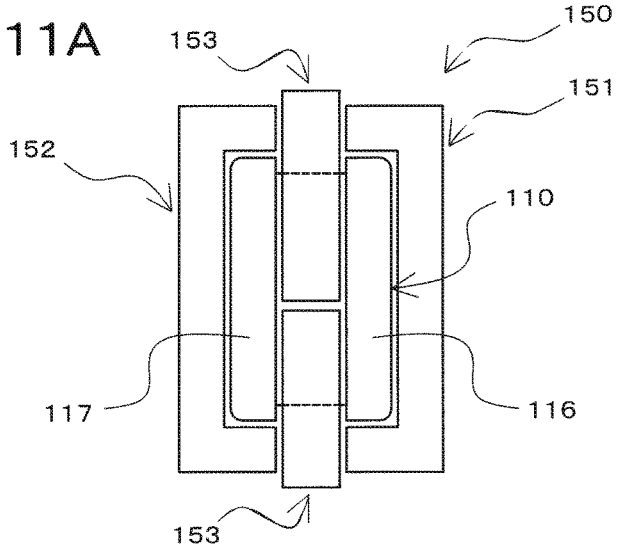
FIG. 11A is a diagram schematically showing a mold used when molding the connector housing shown in FIG. 10, is a simplified view of only portions of the mold that are for forming a seal ring mounting portion, and shows the state where the mold is closed.
Figure 11B:
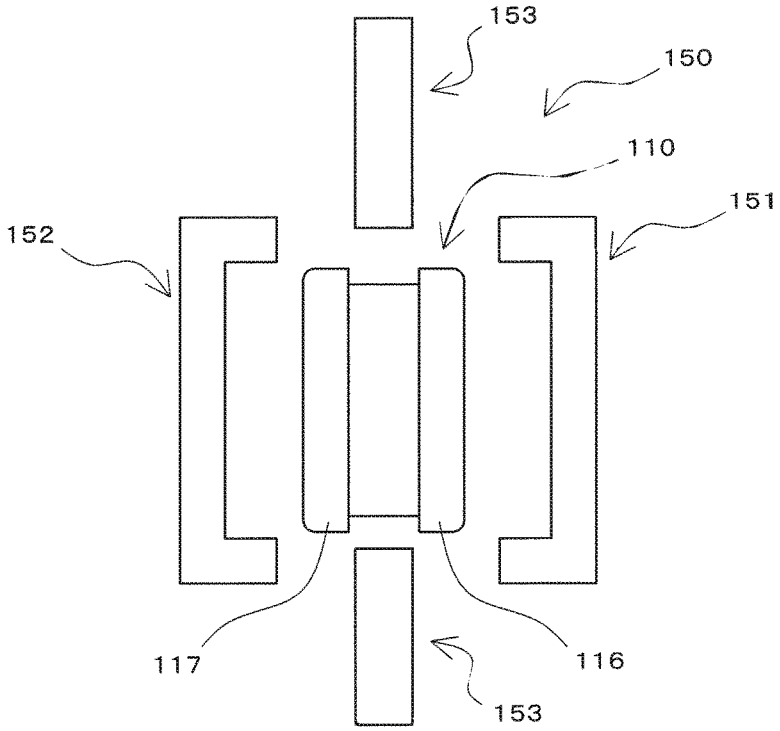
FIG. 11B is a diagram schematically showing the mold used when molding the connector housing shown in FIG. 10, is a simplified view of only portions of the mold that are for forming the seal ring mounting portion, and shows the state where the mold is open.

FIG. 10 is a perspective view of a conventionally-known connector housing 102. FIGS. 11A and 11B are diagrams schematically showing a mold 150 used when molding the connector housing 102 shown in FIG. 10, and are simplified views showing only the portion of the mold for forming the seal ring mounting portion 110. FIG. 11A shows the state where the mold 150 is closed, and FIG. 11B shows the state where the mold 150 is open. Note that FIGS. 11A and 11B schematically show only the seal ring mounting portion 110 of the connector housing 102 along with the mold 150.

The configurations of the cable insertion portion 103 and the terminal housing portion 107 of the conventionally-known connector housing 102 are the same as in the connector housing 2 of the present embodiment. However, the configuration of a seal ring mounting portion 110 is different from in the connector housing 2 of the present embodiment.

In the seal ring mounting portion 110 of the conventionally-known connector housing 102, a pair of wall portions 116 and 117 that sandwich and hold the seal ring 30 are continuous over the entire circumference of the outer circumferential surface portion 118, and therefore overlap each other in a view along the front-rear direction.

In the case of molding the seal ring mounting portion 110 having this shape, as shown in FIGS. 11A and 11B, slide cores 153 are needed in addition to an upper mold 151 and a lower mold 152.

Figure 6A:
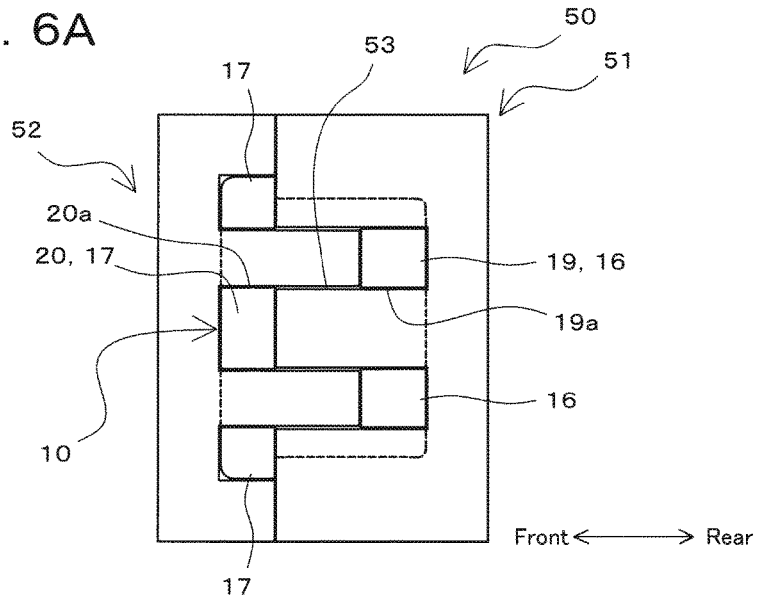
FIG. 6A is a diagram schematically showing a mold used when molding the connector housing shown in FIG. 3, is a simplified view of only portions of the mold that are for forming a seal ring mounting portion, and shows the state where the mold is closed.
Figure 6B:
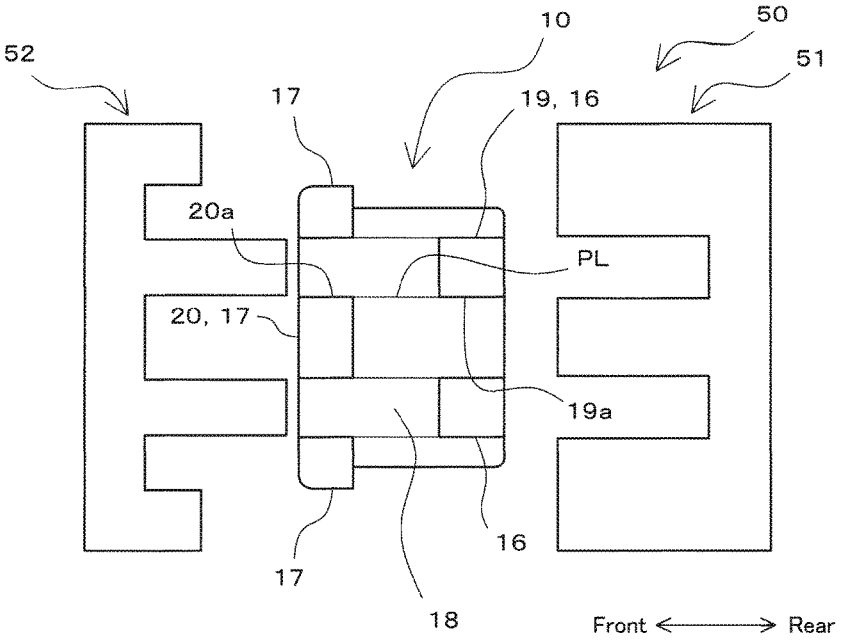
FIG. 6B is a diagram schematically showing the mold used when molding the connector housing shown in FIG. 3, is a simplified view of only portions of the mold that are for forming the seat ring mounting portion, and shows the state where the meld is open.

In contrast, in the seal ring mounting portion 10 of the connector housing 2 according to the present embodiment, the first wall portions 16 and the second wall portions 17 do not overlap each other in a view along the front-rear direction. Accordingly, an undercut portion in the conventionally-known connector housing 102 (the portion sandwiched between the pair of wall portions 116 and 117 in the seal ring mounting portion 110) is eliminated. Accordingly, the portion for molding the seal ring mounting portion 10 in the mold can be formed by simply the upper mold 51 and the lower mold 52 as shown in FIGS. 6A and 6B, thus eliminating the need for slide cores. In other words, according to the connector housing 2 of the present embodiment, slide cores can be omitted, thus making it possible to reduce the mold cost. FIGS. 6A and 6B are diagrams schematically showing the mold 50 used when molding the connector housing 2 shown in FIG. 3, and show a simplified view of only portions of the mold for forming the seal ring mounting portion 10. FIG. 6A shows the state where the mold 50 is closed, and FIG. 6B shows the state where the mold 50 is open. Note that FIGS. 6A and 6B schematically show only the seal ring mounting portion 10 of the connector housing 2 along with the mold 50.

As shown in FIGS. 6A and 6B, in the seal ring mounting portion 10 of the connector housing 2 according to the present embodiment, letting a first wall portion 16 and a second wall portion 17 that are adjacent 11*a* the circumferential direction of the outer circumferential surface portion 18 be an adjacent first wall portion 19 and an adjacent second wall portion 20 respectively an end portion 19*a* of the adjacent first wall portion 19 on the adjacent second wall portion 20 side and an end portion 20*a* of the adjacent second wall portion 20 on the adjacent first wall portion side are arranged on a straight line that extends along the front-rear direction. In other words, in a view along the front-rear direction, a gap is not formed between a first wall portion 16 and a second wall portion 17 that are adjacent in the circumferential direction of the outer circumferential surface portion 18. According to this configuration, the lengths of the first wall portion 16 and the second wall portion 17 can be set longer in the circumferential direction of the outer circumferential surface portion 18. Accordingly it is possible to more reliably prevent twisting of the seal ring 30 when mounted to the seal ring mounting portion 10, and also separation of the seal ring 30 from the seal ring mounting portion 10.

In the case of providing the first wall portions 16 and the second wall portions 17 such that the end portions 19*a* and the end portions 20*a* are arranged along a line that extends in the front-rear direction as described above, a parting line PL, which is formed at a position corresponding to meeting surfaces 53 of the upper mold 51 and the lower mold 52, is formed at the positions shown in FIGS. 3, 4, and 6B. By forming the meeting surfaces 53 of the upper mold 51 and the lower mold 52 such that these parting lines PL are formed, it is possible to form the mold 50 that does not need slide cores. Note that the parting are shown as thin straight lines in FIGS. 3, 4, and 6B.

Note that it is preferable that the above-described parting lines PL are made as inconspicuous as possible by appropriately setting molding conditions such as the injection pressure, and in the connector housing 2 of the present embodiment as well, conditions are set such that the parting lines are as inconspicuous as possible. However, due to being set at the above-described positions corresponding to the meeting surfaces 53 of the upper mold 51 and the lower mold 52, there are cases where these parting lines PL unavoidably slightly appear on the product.

As described above, according to the connector housing 2 of the present embodiment, by mounting the seal ring 30 to the seal ring mounting portion 10, the seal ring 30 can be attached to the connector housing 2. Specifically, with the connector housing 2, when the seal ring 30 is mounted to the seal ring mounting portion 10 such that the inner circumferential portion of the seal ring 30 is in close contact with the outer circumferential surface portion 18, portions of the seal ring 30 on the two width-direction sides are sandwiched and held by the first wall portions 16 and the second wall portions 17. Accordingly, the seal ring 30 can be securely attached to the connector housing 2.

Also, according to the connector housing 2, the configuration of the mold 50 used when molding the connector housing 2 can be simplified for the following reasons.

For example, in the case where the portion of the connector housing into which the seal ring is fitted has wall portions that hold portions of the seal ring on the two width direction sides over the entire circumference as disclosed in JP 2016-48604A described above for example, it is necessary to use a mold that has a slide core, and the mold cost increases.

In contrast, with the connector housing 2, the first wall portions 16 and the second wall portions 17 that sandwich and hold the seal ring 30 are provided so as to not overlap each other in a view from the central axis direction of the seal ring 30 in the state of being mounted to the seal ring mounting portion 10 (i.e., in a view along the front- ear direction, or the direction of removal from the mold). Accordingly, the seal ring mounting portion 10 does not become an undercut portion, and there is no need for a slide core, thus making it possible to reduce the number of mold parts.

Accordingly, with the connector housing 2, it is possible to provide a connector housing having a structure to which a seal ring can be fitted without inviting a rise in the cost of the mold.

If the seal ring mounting portion were configured using one first wall portion and one second wall portion for example, there would be concerns of problems such as the following. Specifically, when the seal ring 30 is mounted to the seal ring mounting portion having one first wall portion and one second wall portion, the portion of the seal ring 30 that is on the opposite side, in the width direction, to the portion that abuts against the first wall portion (i.e., the portion that does not abut against the second wall portion) extends continuously along the circumferential direction of the seal ring 30. Similarly, when the seal ring 30 is mounted to the seal ring mounting portion having one first wall portion and one second wall portion, the portion of the seal ring 30 that is on the opposite side, in the width direction, to the portion that abuts against the second wall portion (i.e., the portion that does not abut against the first wall portion) extends continuously along the circumferential direction of the seal ring. In this case, this portion easily becomes twisted relative to the seal ring mounting portion, or easily becomes separated from the seal ring mounting portion.

In contrast, with the connector housing 2, a plurality of first wall portions 16 and second wall portions 17 are arranged so as to alternate along the circumferential direction of the outer circumferential surface portion 18. Accordingly, the portions of the seal ring 30 that do not abut against the first wall portions 16 or the second wall portions 17 do not extend continuously along the circumferential direction. According to this configuration, portions of the seal ring 30 that do not abut against the first wall portions 16, or portions of the seal ring 30 that do not abut against the second wall portions 17, are not likely to become twisted or separated from the seal ring mounting portion 10. In other words, according to the connector housing 2, it is possible to prevent the seal ring 30 mounted to the seal ring mounting portion 10 from becoming twisted or separated from the seal ring mounting portion 10.

According to the connector housing 2, the lengths of the first wall portions 16 and the second wall portions 17 ran be set long in the circumferential direction of the outer circumferential surface portion 18, without the first wall portions 16 and the second wall portions 17 overlapping each other in a view from the central axis direction of the seal ring 30 when mounted to the seal ring mounting portion 10 (i.e., in a view along the front-rear direction). Accordingly it is possible to more reliably prevent twisting of the seal ring 30 when attached to the seal ring mounting portion 10, and also separation of the seal ring 30 from the seal ring mounting portion 10.

The meeting surfaces 53 of the upper mold 51 and the lower mold 52 of the mold 50 for forming the connector housing 2 are portions where parting lines PL are formed on the connector housing 2. In other words, by configuring the connector housing 2 so as to have the parting lines PL described above, it is possible to manufacture the mold 50 that does not need a slide core.

According to the connector 1 having this connector housing 2, it is possible to provide a connector that includes a connector housing having a structure to which a seal ring can be fitted without inviting a rise in the cost of the mold.

Although an embodiment of the present invention has been described above, the present invention is not limited to the above-described embodiment, and various modifications can be made without departing from the gist of the present invention.

Figure 7:
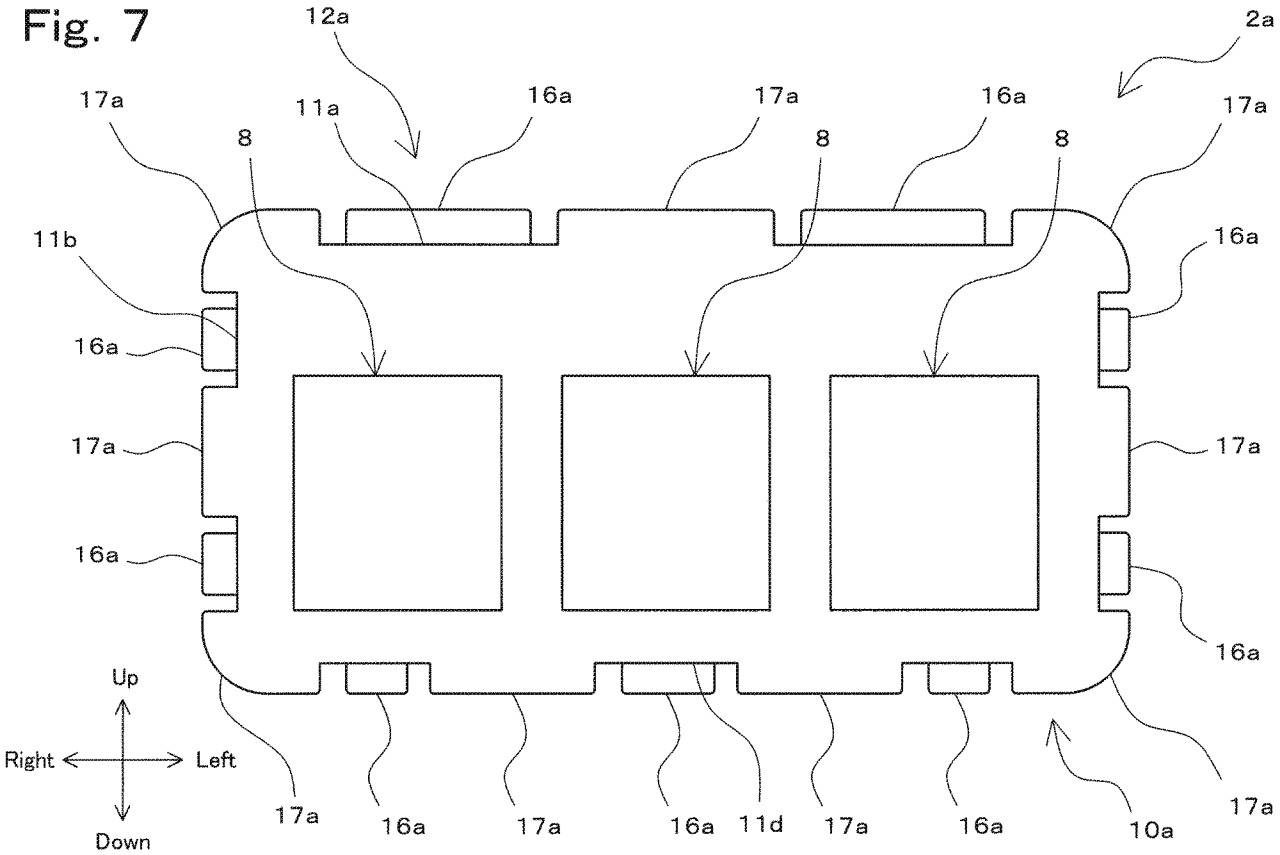
FIG. 7 is a diagram of a connector housing of a connector according to a variation, as viewed from the front.

Variations (1) FIG. 7 is a diagram of a connector housing 2*a* of a connector according to a variation, as viewed from the font. In the above embodiment, as shown in FIG. 5, the first wall portions 16 and the second wall portions 17 are formed such that gaps are not formed between first wall portions 16 and second wall portions 17 that are adjacent in the circumferential direction of the outer circumferential surface portion 18 in a view along the front-rear direction. However, the present invention is not limited to this, and as shown in FIG. 7, gaps may be formed between first wall portions 16*a* and second wall portions 17*a* that are adjacent in the circumferential direction of the outer circumferential surface portion 18 in a view form the front-rear direction. Even with the connector housing 2*a* that includes the seal ring mounting portion 10*a* having the holding portion 12*a* with this configuration, similarly to the embodiment described above, it is possible to provide a connector housing having a structure to which a seal ring can be fitted without inviting a rise in the cost of the mold.

Figure 8:
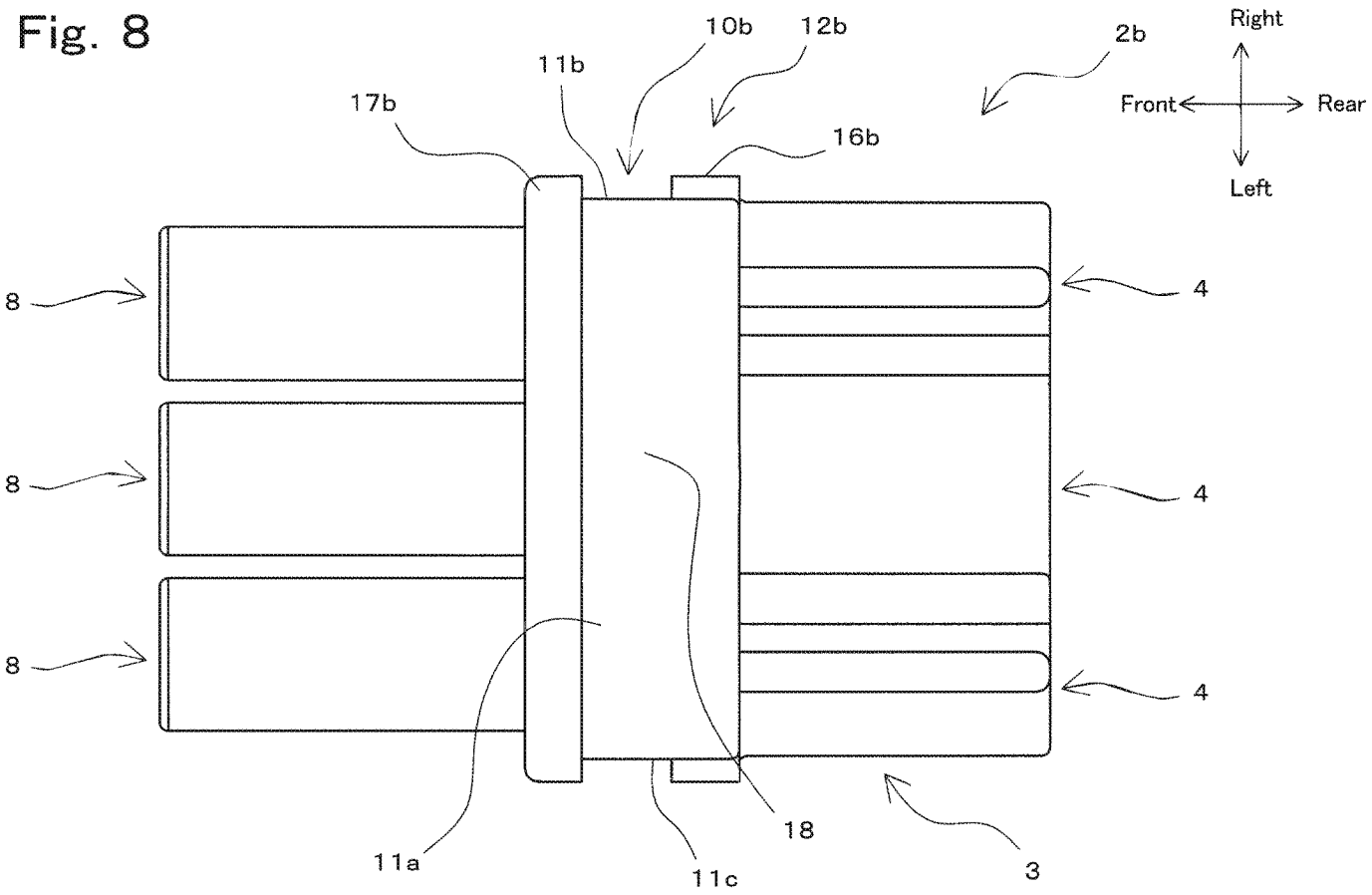
FIG. 8 is a diagram of a connector housing of a connector according to a variation, as viewed from above.
Figure 9:
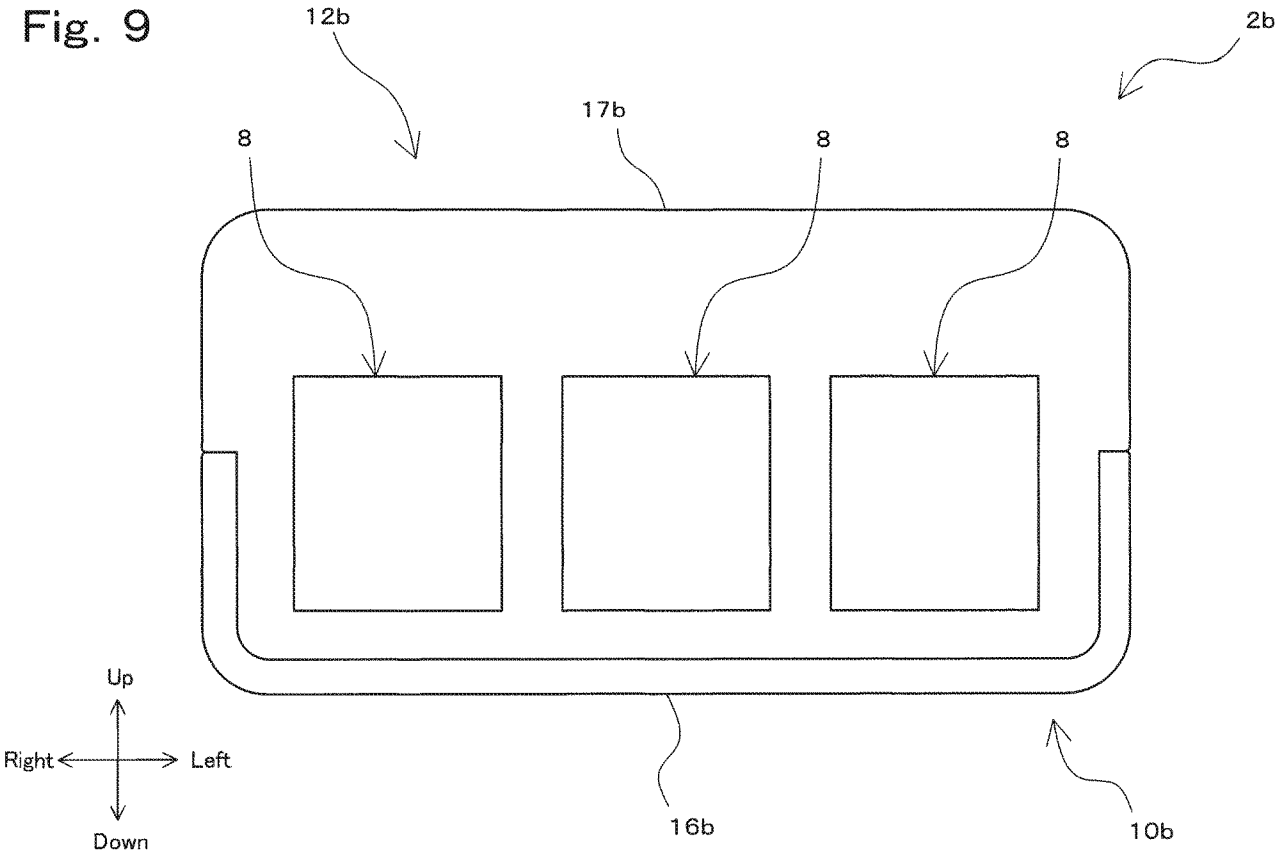
FIG. 9 is a diagram of the connector housing shown in FIG. 8, as viewed from the front.

(2) FIG. 8 is a diagram of a connector housing 2*b* of a connector according to a variation, as viewed from above. Also, FIG. 9 is a diagram of the connector housing 2*b* shown in FIG. 8, as viewed from the front. In the above embodiment, the holding portion 12 is constituted by a plurality of first wall portions 16 and a plurality of second wall portions 17, but the present invention is not limited to this. Specifically as shown in FIGS 8 and 9, a holding portion 12*b* may be constituted by one first wall portion 16*b* and one second wall portion 17*b*. The first wall portion 16*b* is formed on a lower half portion of the outer circumferential surface portion 18 of the seal ring mounting portion 10*b*. On the other hand, the second wall portion 17*b* is formed on an upper half portion of the outer circumferential surface portion 18. With this configuration, similarly to the above embodiment, portions of the seal ring 30 on the two width direction sides can be sandwiched and held in the holding portion 12*b*, and it is possible to omit a slide core from the mold for forming this connector housing 2. Accordingly, even with the connector housing 2*b* according to the present variation, similarly to the above embodiment, it is possible to provide a connector housing having a structure to which a seal ring can be fitted without inviting a rise in the cost of the mold.

What is claimed is:

1. A connector housing as a molded article having a seal ring mounting portion to which a seal ring is to be mounted, wherein the seal ring mounting portion comprises:

an outer circumferential surface portion that is provided so as to come into close contact with an inner circumferential portion of the seal ring, and extends along a circumferential direction of the seal ring in a state of being in close contact with the inner circumferential portion of the seal ring; and a holding portion that has a first wall portion provided on one width-direction side of the outer circumferential surface portion and a second wall portion provided on another width-direction side of the outer circumferential surface portion, the holding portion sandwiching and holding the seal ring from two sides in a width direction of the seal ring by the first wall portion and the second wall portion in the state of the seal ring being in close contact with the outer circumferential surface portion, and the first wall portion and the second wall portion are provided so as to not overlap each other in a view from a central axis direction of the seal ring in a state of being mounted to the seal ring mounting portion, wherein the first wall portion includes at least two first projection portions and a first gap portion disposed therebetween, wherein the outer circumferential surface portion has at least one upper surface extending in the central axis direction from the second wall portion to the first gap portion disposed between the two first projection portions, wherein the first wall portion does not extend around the first gap portion.

2. The connector housing according to claim 1, wherein the second wall portion includes at least two second projection portions and a second gap portion disposed therebetween, the first projection portions and the second projection portions being arranged so as to alternate along an extending direction of the outer circumferential surface portion.

3. The connector housing according to claim 1, wherein the first wall portion and the second wall portion that are adjacent in an extending direction of the outer circumferential surface portion are respectively provided as an adjacent first wall portion and an adjacent second wall portion, and an end portion of the adjacent first wall portion on an adjacent second wall portion side and an end portion of the adjacent second wall portion on an adjacent first wall portion side are arranged on a straight line that extends in the central axis direction of the seal ring in the state of being mounted to the seal ring mounting portion.

4. The connector housing according to claim 3, wherein a parting line is formed on the outer circumferential surface portion, the parting line extending from the end portion of the adjacent first wall portion on the adjacent second wall portion side to the end portion of the adjacent second wall portion on the adjacent first wall portion side.

5. A connector comprising:

the connector housing according to claim 1;

a seal ring mounted to the seal ring mounting portion of the connector housing; and a terminal portion housed inside the connector housing.

* * * * *